US006554013B2

(12) United States Patent
Brown

(10) Patent No.: US 6,554,013 B2
(45) Date of Patent: Apr. 29, 2003

(54) TRANSPORTABLE COLLECTIVE PROTECTION SYSTEM

(75) Inventor: Louis Brown, North Bay (CA)

(73) Assignee: 1289309 Ontario Limited, North Bay (CA)

( * ) Notice: Subject to any disclaimer, the term of this patent is extended or adjusted under 35 U.S.C. 154(b) by 0 days.

(21) Appl. No.: 10/140,930

(22) Filed: May 9, 2002

(65) Prior Publication Data

US 2002/0174888 A1 Nov. 28, 2002

Related U.S. Application Data

(63) Continuation of application No. 09/437,337, filed on Nov. 10, 1999, now Pat. No. 6,390,110.

(51) Int. Cl.[7] ..... A47K 3/00; F24F 9/00

(52) U.S. Cl. ..... 135/93; 135/156; 135/97; 600/21; 52/2.11; 52/2.17

(58) Field of Search ..... 52/2.11, 79.5, 52/2.17; 135/87, 93, 97, 156; 600/21; 55/385.2; 454/338, 187; 4/597, 599, 600

(56) References Cited

U.S. PATENT DOCUMENTS 2,910,994 A * 11/1959 Joy
3,261,659 A * 7/1966 Schwichtenberg
3,345,996 A * 10/1967 Sadove et al.
3,501,213 A * 3/1970 Trexler
3,670,747 A * 6/1972 Pohl et al.
3,766,844 A * 10/1973 Donnelly et al.
4,304,224 A * 12/1981 Fortney
4,348,777 A * 9/1982 Peterson
4,442,162 A * 4/1984 Kuester
4,675,923 A * 6/1987 Ashley
4,707,953 A * 11/1987 Anderson et al.
4,800,597 A 1/1989 Healey
4,858,256 A * 8/1989 Shankman
5,090,972 A * 2/1992 Eller et al.
5,261,436 A * 11/1993 Funk ..... 135/105
5,326,211 A * 7/1994 Critchley
5,331,991 A * 7/1994 Nilsson
5,394,897 A * 3/1995 Ritchey et al.
5,537,784 A * 7/1996 Baldwin
5,551,102 A 9/1996 Stewart et al.
5,562,539 A * 10/1996 Hashimoto et al.
5,638,848 A * 6/1997 November ..... 135/90
6,021,794 A * 2/2000 Guerra
6,390,110 B1 * 5/2002 Brown ..... 135/93

FOREIGN PATENT DOCUMENTS

EP 0 178 091 4/1986

* cited by examiner

*Primary Examiner*—Robert Canfield
(74) *Attorney, Agent, or Firm*—Harold C. Baker

(57) ABSTRACT

A modulator transportable collective protection system for the decontamination and containment of personnel in a toxic free area. A contamination containment area is provided through which personnel are decontaminated prior to entering the toxic free area. The migration of contaminants is prevented by causing a purge of clean filtered air from the toxic free area to the contamination control area and to the exterior environment. A blower and filter unit provides air to the toxic free area to maintain an over pressure therein, ensuring that all entry to the toxic free area is through a flow of clean air.

2 Claims, 10 Drawing Sheets

TRANSPORTABLE COLLECTIVE PROTECTION SYSTEM

This application is a continuation application of U.S. application Ser. No. 09/437,337 filed Nov. 10, 1999, now U.S. Pat. No. 6,390,110.

BACKGROUND OF THE INVENTION

The present invention relates to transportable collective protection systems for decontamination of personnel, and provision of toxic-free areas where injured or infected people can be retained safe from further exposure to nuclear, biological, or chemical hazards (NBC).

Such systems are required for both military and civilian applications. They should be readily transportable by land or air, and capable of being quickly set up with a minimum of personnel, either in contaminated or toxic-free locations. Such systems must come complete with their own power supplies, air filter equipment, air conditioning, lighting, plumbing, and be capable of transport to required sites by aircraft or ground vehicles.

Performance specifications for such systems require a high standard of materials and design to meet operational requirements in a variety of environments, to safeguard personnel from lethal hazards. This molecular collective protection system must be capable of providing relief from psychological and physiological stresses during sustained operations in a contaminated environment due to the wearing of full Individual Protection Equipment (IPE). The system provides the ability to process contaminated personnel through a Contamination Control Area (CCA) into a Toxic Free Area (TFA), as defined in NATO standards, consistent with service decontamination and contamination control procedures.

RELEVANT PRIOR ART

U.S. Pat. No. 4,707,953 granted Nov. 24, 1987 to Anderson discloses a light-weight expandable shelter providing protection against chemical, biological agents and nuclear fallout. The shelter has a frame of U-shaped ribs spaced and held parallel by a series of reinforcing members. A cover of flexible material resistant to chemical and biological agents is attached to the frame. An airlock is provided at one end of the shelter, through which access can be gained to the shelter. A blower and filter pressurizes the shelter and airlock. Such a shelter is of limited usefulness for personnel protection. Injured or non-ambulatory personnel cannot be passed through the airlock, and the shelter is not capable of modular expansion to provide different areas for specialized activities. This shelter requires numerous personnel to erect it and considerable time for erection to be completed. Disassembling the shelter would also be slow and labor intensive.

Healey, U.S. Pat. No. 4,800,597 issued Jan. 31, 1989 discloses a decontamination shelter consisting of a series of small rooms, each large enough for an individual to disrobe, shower and dress. Each room is separated from the adjacent room by a narrow corridor with a door at one end leading into the corridor from a first room and a door at the opposite end of the corridor giving access to the adjacent room, the corridors being for isolation between rooms.

Canadian Patent 2,080,498 issued Mar. 19, 1996, and its U.S. Pat. No. 5,331,991 issued Jul. 24, 1994, disclose a method of establishing and maintaining in sealed tents, an environment which is independent from its surroundings. Filtered air is used to pressurize the tent, and recycled air from the tent is mixed with filtered outside air, when an air pressure is reached, which is higher than a predetermined air pressure. The patent does not disclose entrance and exit details of the tent which impact on the maintenance of pressure within the sealed tent, nor does it address the problems of moving personnel from a contaminated environment to a sealed space, while decontaminating personnel and equipment.

SUMMARY OF THE INVENTION

The present invention overcomes all of the limitations of the prior art by providing a transportable collective protection system, which is modular and capable of assembly and operation in both contaminated and toxic free environments, and which permits the decontamination of personnel and equipment in a contamination containment area (CCA), prior to entry into the toxic free area (TFA). The migration of contaminants from the CCA to the TFA is prevented by complete decontamination in the CCA, followed by transfer of decontaminated personnel and equipment to the TFA, while maintaining an over-pressure in the TFA causing a purge of clean filtered air from the shelter through the CCA. The over-pressure is maintained by a blower and filter unit which draws in external air, filters it to remove contaminants, and pressurizes the TFA and CCA to a pressure sufficient to inflate the system to a self supporting state and to purge the CCA and any other minor leakage through closures. Separate electrical generating equipment provides power to run the blower and filter unit as well provides power for lighting, heating, air conditioning, and operation of internal equipment, including fresh water and waste water systems.

BRIEF DESCRIPTION OF THE DRAWINGS

In the accompanying drawings.

DETAILED DESCRIPTION OF THE PREFERRED EMBODIMENTS

Figure 1:
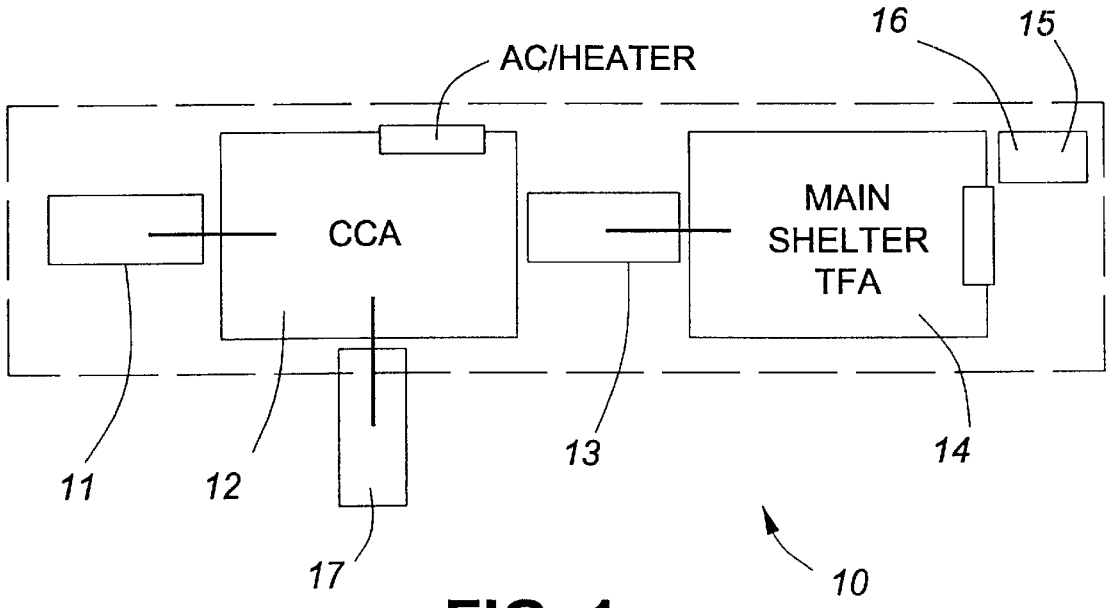
FIG. 1 is a plan view of a collective protection system in accordance with the present invention.

Referring to FIG. 1, there is shown in plan view a collective protection system 10 consisting of an entrance 11 into a Contamination Control Area (CCA) 12, coupled through an air lock 13 to a Toxic Free Area 14, connected to a Generator 15 and NBC filter and fan unit 16. A second exit 17 is connected to the CCA 12. The CCA 12, TFA 14, entrance 11, airlock 13, and exit 17 which form the inner liner of the system are constructed of an air tight plastic with welded seams and are connected together by zippers joining the components. Preferably, the plastic material of the liner is a chemical resistant composite consisting of a High Density Polyethylene (HDPE) woven material, laminated to a barrier film and coated on both sides with low density polyethylene LDPE films. UV inhibitors and flame resistant additives are added to provide for long term outdoor exposure and a degree of fire resistance. The outer shell of the system 10 (not shown on FIG. 1) is mounted on a standard modular tent frame consisting of A frames and purlins of aluminum, the outer shell being a similar HDPE weave, laminated to a barrier film and coated on both sides with LDPE. The exterior surface is treated with a coating dyed Desert Tan or Olive Drab, as required. By increasing the weight of the outer cover it is possible to provide protection from shrapnel. Examples of inner liner and outer shell materials are shown in tables 1, 2 and 3.

TABLE 1

Chemical Resistant Inner Liner
High density polyethylene weave laminated to a barrier film and coated on both sides with low density polyethylene

| Property | Unit | | Values | Test Method |
|---|---|---|---|---|
| Construction | Tapes/in | Warp | 9.1 | ASTM D3775 |
| | Tapes/in | Weft | 8.9 | |
| Unit Weight | oz/yrd2 | | 6.6 | ASTM D3775 |
| Tensile Grab | lbf | Warp | 178 | ASTM D1682-64 |
| Strength | lbf | Weft | 202 | |
| Tear Strength | lbf | Warp | 27 | ASTM D2261-71 |
| *(tongue) | lbf | Weft | 34 | ASTM D2261-71 |
| Coating Thickness | mil | Natural | 1.5 | ASTM D1777 MOD |
| | mil | Natural | 1.5 | |
| Flammability | | | Pass | NFPA 701 L |

Barrier film is laminated to HDPE woven scrum and then coated on both sides with DDPE, UV inhibitors and flame resistant additives are added to provide for long term outdoor exposure and a degree of fire resistance. These values are typical and are not intended as limiting specifications.

TABLE 2

Chemical Resistant Outer Cover (Light Weight)
High density polyethylene weave laminated to a barrier film and coated on both sides with low density polyethylene

| Property | Unit | | Values | Test Method |
|---|---|---|---|---|
| Construction | Tapes/in | Warp | 10.2 | ASTM D3775 |
| | Tapes/in | Weft | 10.4 | |
| Unit Weight | oz/yrd2 | | 7.3 | ASTM D3775 |
| Tensile Grab | lbf | Warp | 225 | ASTM D1682-64 |
| Strength | lbf | Weft | 208 | |
| Tear Strength | lbf | Warp | 40 | ASTM D2261-71 |
| *(tongue) | lbf | Weft | 62 | ASTM D2261-71 |
| Coating Thickness | mil | Desert Tan Olive Drab | 1.6 | ASTM D1777 MOD |
| | Mil | Desert Tan Olive Drab | 1.6 | |
| Flammability | | | | NFPA 701 L |

Barrier film is laminated to HDPE woven scrum and then coated on both sides with DDPE, UV inhibitors and flame resistant additives are added to provide for long term outdoor exposure and a degree of fire resistance. These values are typical and are not intended as limiting specifications.

TABLE 3

Chemical Resistant Outer Cover (Heavy Weight)
High density polyethylene weave laminated to a barrier film and coated on both sides with low density polyethylene

| Property | Unit | | Values | Test Method |
|---|---|---|---|---|
| Construction | Tapes/in | Warp | 16 | ASTM D3775 |
| | Tapes/in | Weft | 16 | |
| Unit Weight | oz/yrd2 | | 10 | ASTM D3775 |
| Tensile Grab | lbf | Warp | 371 | ASTM D1682-64 |
| Strength | lbf | Weft | 360 | |
| Tear Strength | lbf | Warp | 116 | ASTM D2261-71 |
| *(tongue) | lbf | Weft | 118 | ASTM D2261-71 |
| Coating Thickness | mil | Desert Tan Olive Drab | 1.6 | ASTM D1777 MOD |
| | Mil | Desert Tan Olive Drab | 1.6 | |
| Flammability | | | | NFPA 701 L |

*Includes force to shift tapes - Tear may be crosswise to direction of force.
Barrier film is laminated to HDPE woven scrum and then coated on both sides with DDPE, UV inhibitors and flame resistant additives are added to provide for long term outdoor exposure and a degree of fire resistance. These values are typical and are not intended as limiting specifications.

Figure 2:
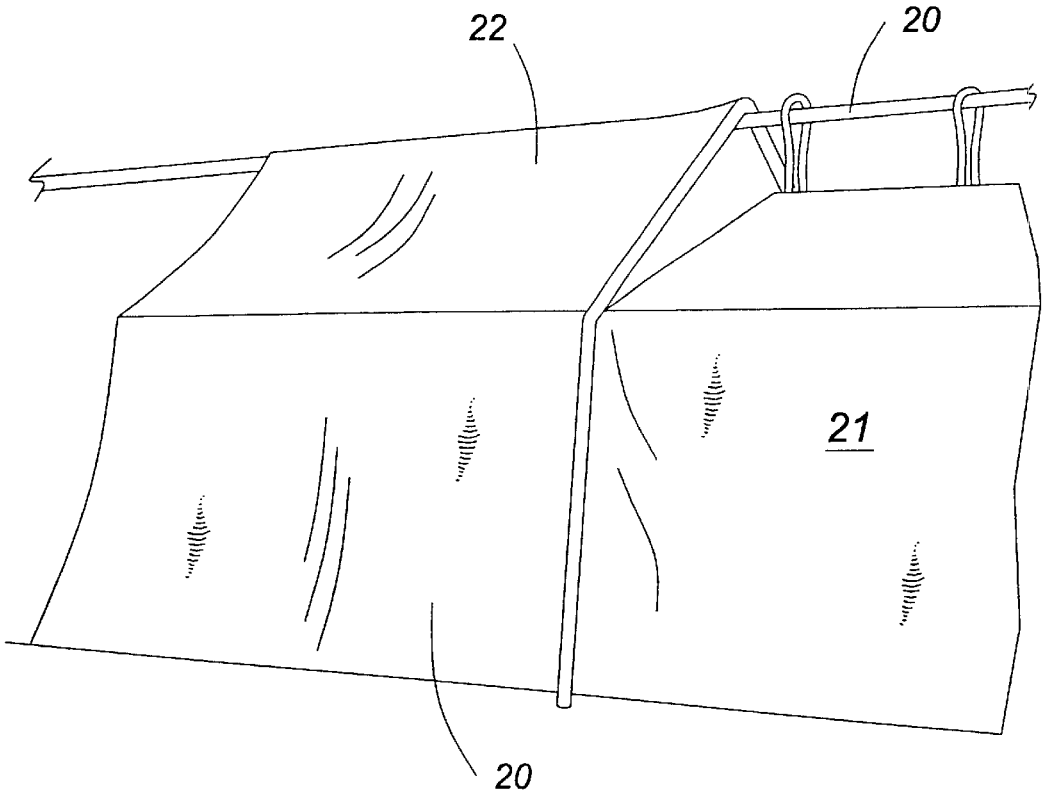
FIG. 2 is an exterior view of the system of FIG. 1 with the outer tent partially removed.

FIG. 2 illustrates the standard modular tent frame 20, with the inner liner 21 inside the frame 20, and an outer shell 22 draped over the frame 20, and held in place by conventional means, including securing the outer shell to the ground around the perimeter of the system. The outer tent chemical cover may optionally be colored with a suitable camouflage pattern, if required by the location and use of the system.

Figure 3:
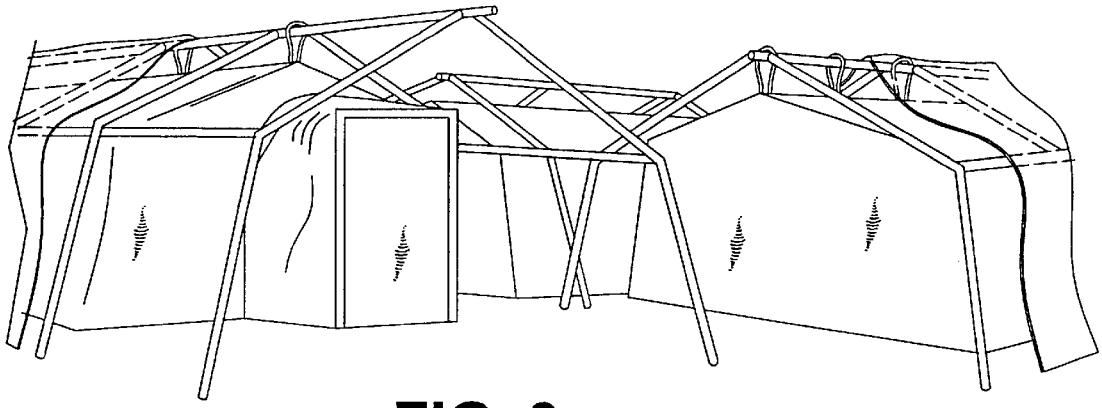
FIG. 3 is a view of a compound of collective protection units, with the outer tents removed.

The illustration of FIG. 3 clearly shows a plurality of interconnected systems with the outer shells removed. The standard modular tent frames clearly may be seen, together with the inner liners positioned within the frames, and with looped tabs extending from the inner liners to the frames.

Figure 4:
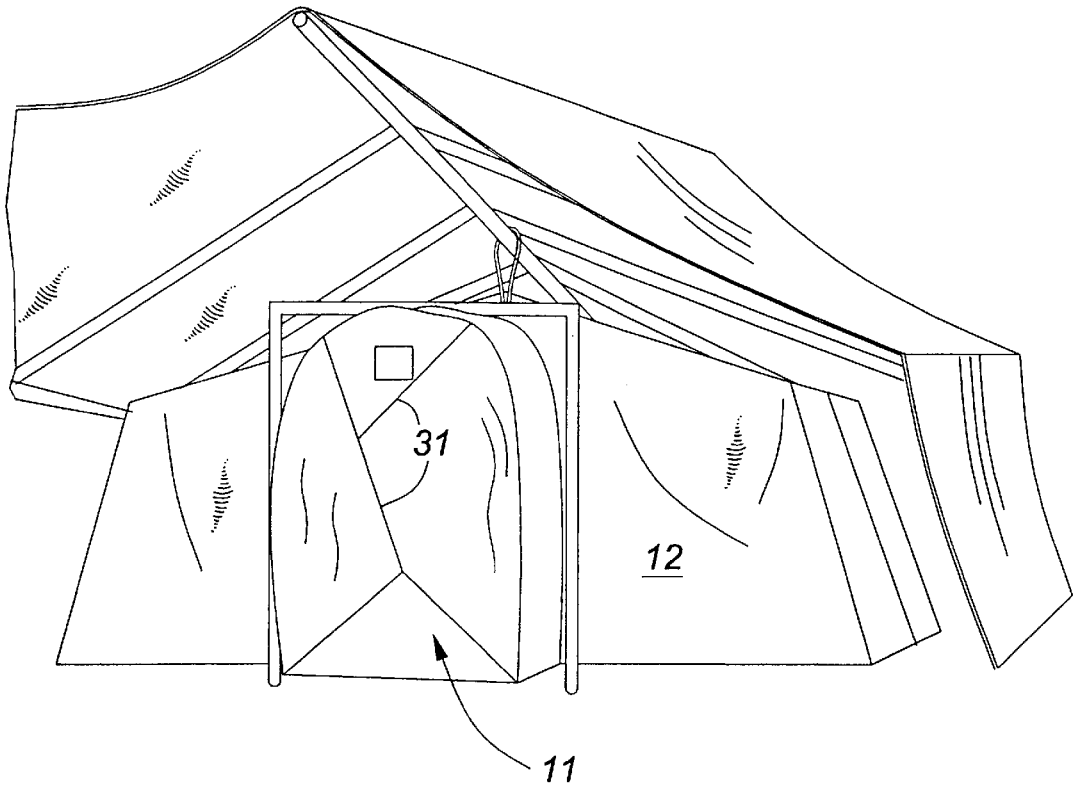
FIG. 4 is an end view of the outer decontamination area of the collective protection system of the invention.

FIG. 4 is a view from the left end of FIG. 1 showing the entrance 11 and the CCA 12. The outer decontamination area is external to the entrance, but beneath the outer shell. Decontaminant containing pans are provided at this location for removing toxic material from personnel and equipment prior entry into the entrance 11 to the CCA 12. The preferred decontaminant used is RSDL, which can be applied to individual protective equipment (IPE), weapons, other equipment, human skin and wounds, without damage, and with instant neutralization of toxic NBC material.

All components of the system may be mounted on a trailer for ground transportation, or a pallet for air transport, which facilitates the rapid movement of systems to locations requiring the systems.

It will be appreciated by those familiar with the difficulty of providing a toxic free area (TFA), that each module of the system is a sealed unit, having a floor, walls and ceiling welded and/or sewn together forming a sealed volume, which may be connected to other modules by zipper connections, having minimal leakage. The important feature is that there is a flow of air through the system toward the source of contamination, and that decontamination occurs principally at the downstream end of the air flow. There is an over pressure maintained in the TFA which ensures that all air flow is toward the source of contamination, as doors are opened and closed, and that nothing is permitted into the TFA that has not been through the CCA. It will be noticed that the zippers 31 of FIG. 4 which comprise the opening into the exit 11, are configured to minimize the escape of air during entry into the CCA 12. By opening the zippers in the doors a limited amount, the flow of air through the CCA 12 can be regulated. Vents are also included in the end walls of the CCA 12 which may be adjusted to ensure adequate flow of air through the CCA 12, and to maintain an over pressure in the TFA.

A typical system of the invention includes on a pellet:

one 10 KV 60 Hz generator fixed to the pallet;

NBC filter system providing a minimum of 300 cfm. And capable of filtering and maintaining an over pressure in three inter-connected units at one time;

an independent air conditioning/heating unit for independent climate control up to three complete connected liner units, each measuring 14 ft.×24 ft. by 6 ft. minimum clearance.

Each liner unit comes with sub-floor, inner floor, emergency repair kit, two replaceable doors all inner support apparatus and an extendible storage or toilet facility. All units come complete with basic electrical hook up system of 110/220 v plug-ins, basic lighting, remote controls and gauges for generator, filter, and AC/heater units.

Figure 5:
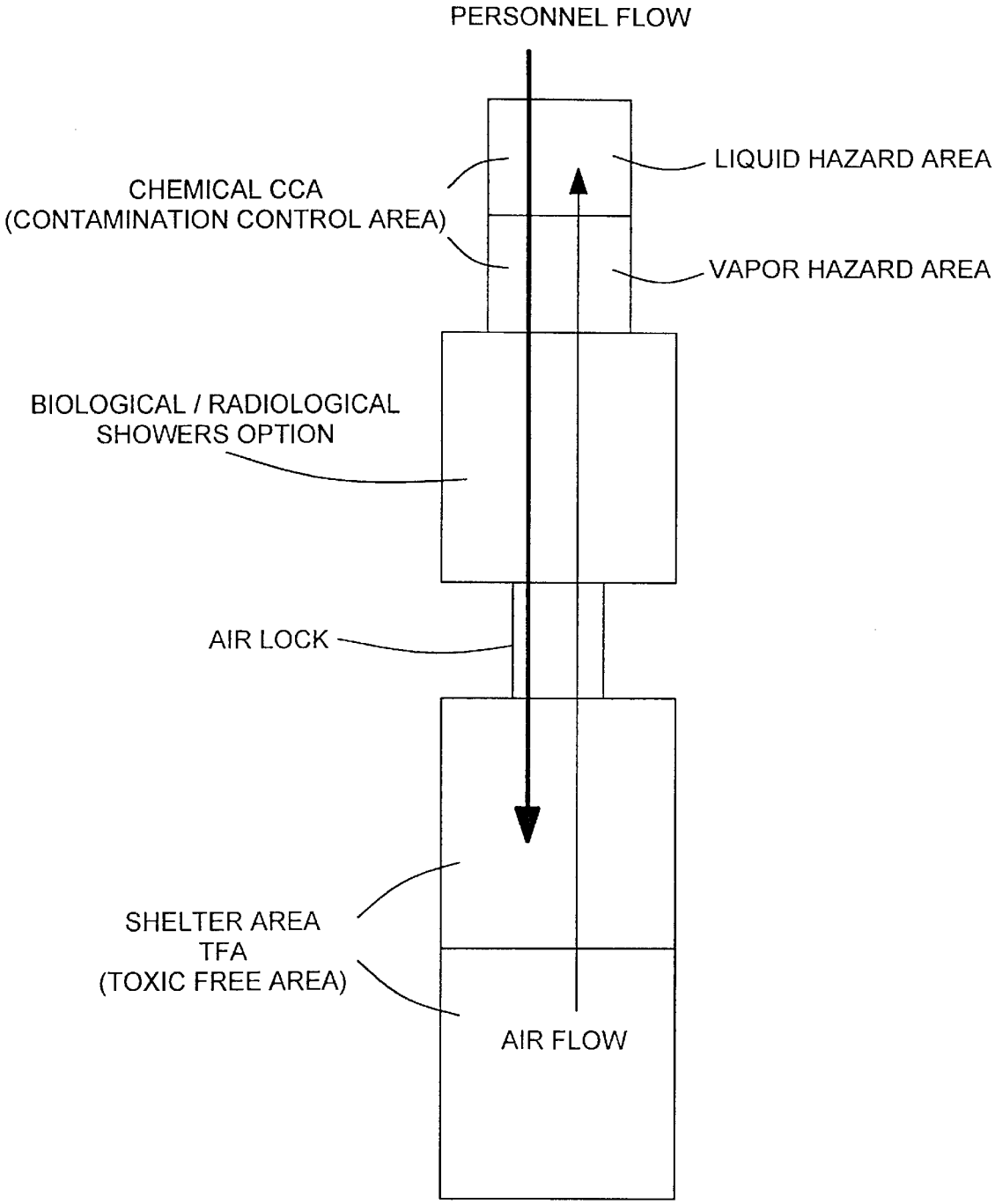
FIG. 5 is a plan view of an alternative arrangement of units showing the personnel movement and counter air flow of the invention.

FIG. 5 is a plan view of a specialized application for biological/radiological showers, illustrating the counter flow of personnel and air flow to maintain the TFA free of contaminants. It will be appreciated that the view of FIG. 5 omits the outer shell for clarity, it being understood that all systems will include such a shell mounted on a standard modular tent frame.

Figure 6:
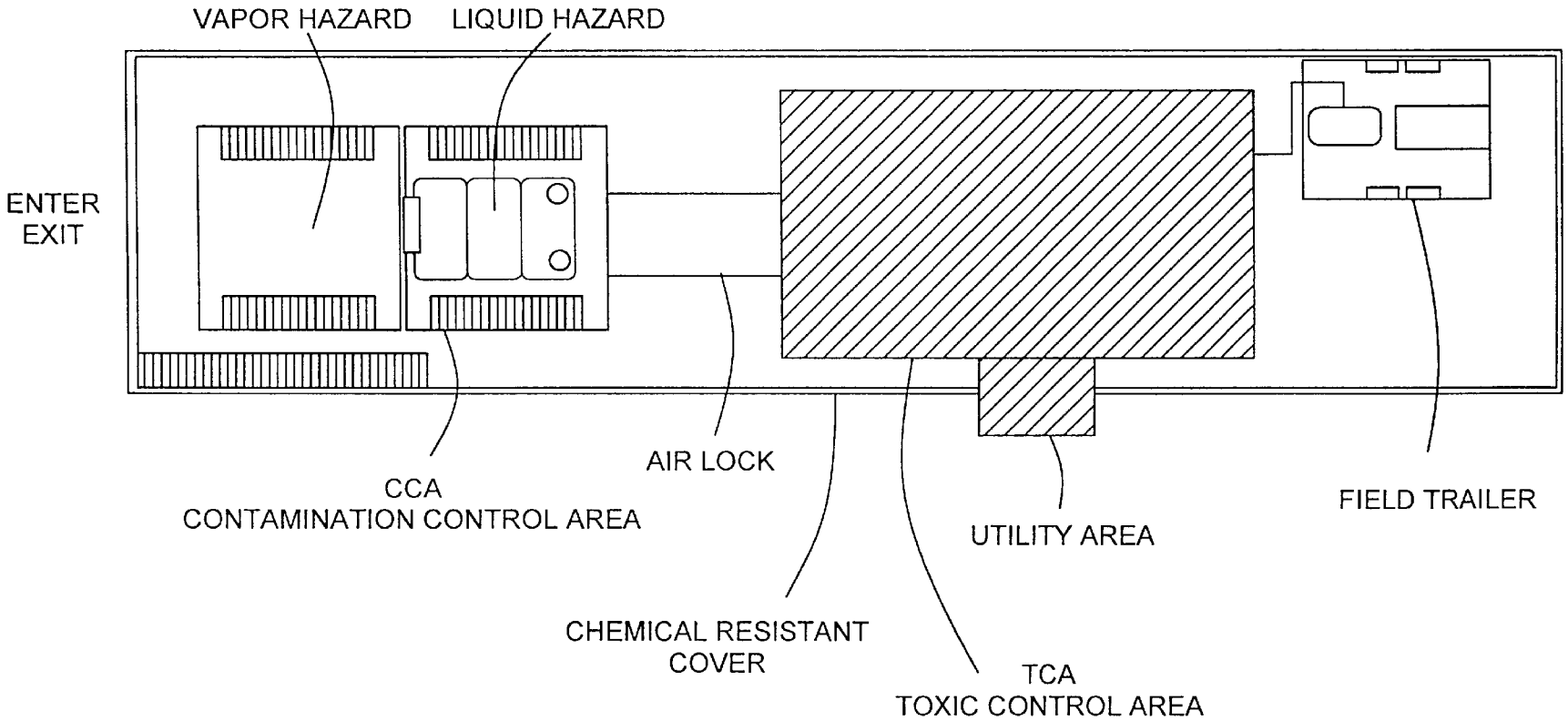
FIG. 6 is a plan view of a toxic control and decontamination unit.

FIG. 6 is a plan view of an alternate arrangement of units, with air flow from right to left in the view and personnel flow from left to right, counter the air flow.

Figure 7:
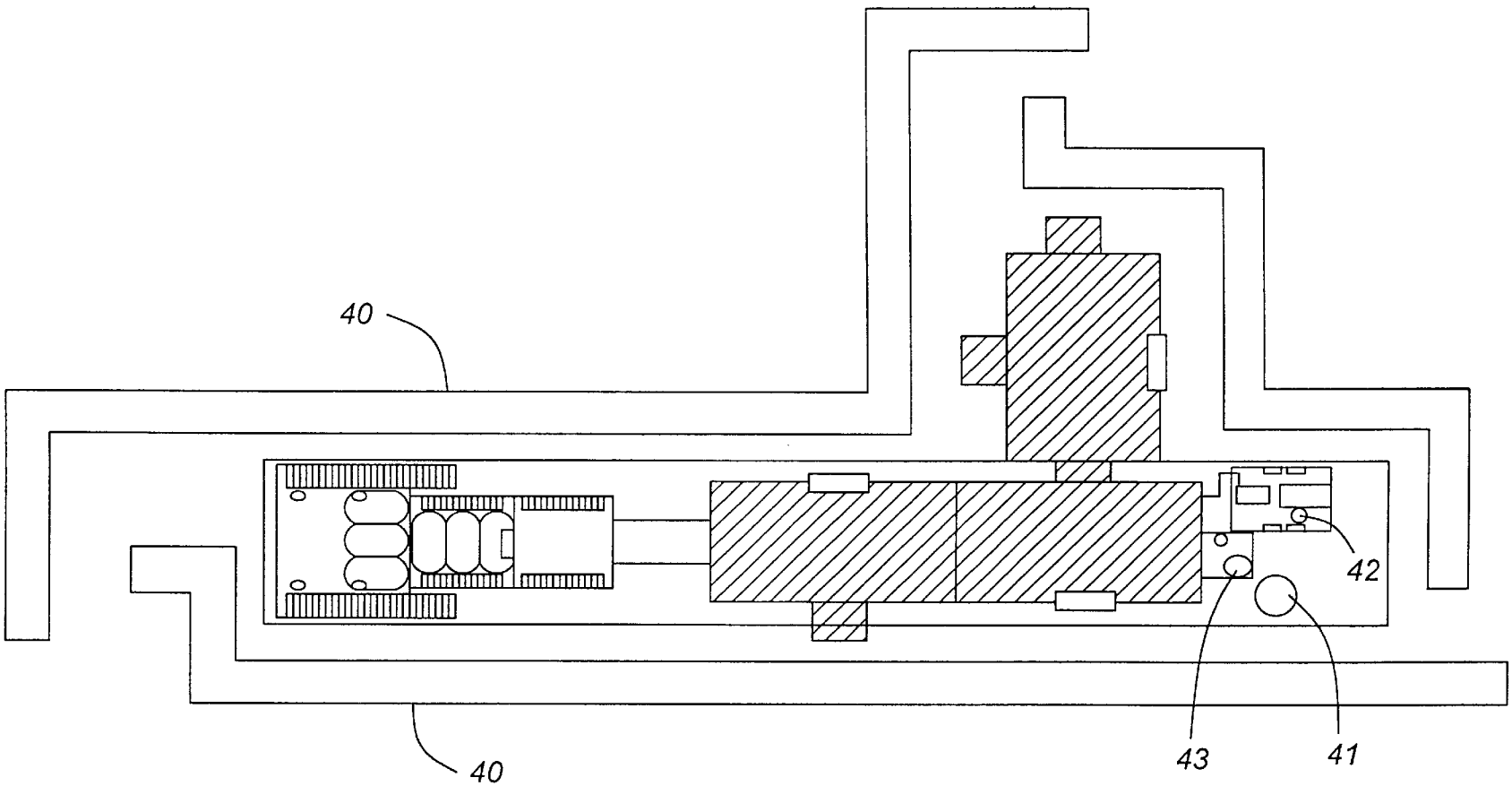
FIG. 7 is a plan view of a three section 120 man sleeping and eating facility, which can also be used for a four bed operating room, fifteen bed field hospital.

FIG. 7 is an alternative arrangement which can provide sleeping and eating facilities for 120 men, or can be used for a four bed operating room/15 bed ward field hospital. The shaded areas 40 represent the typical form of barrier which could be erected around such a facility for security, and to prevent direct penetrating fire of hostile forces from striking the system. As illustrated the outer shell of the system extends over all units of the system, and the TFA at the right hand end of the system is composed of three units joined together, and supplied with water and sanitary facilities from water bladder 41 connected to a water heater 42 on the trailer, connected to shower and toilet unit 43.

Figure 8:
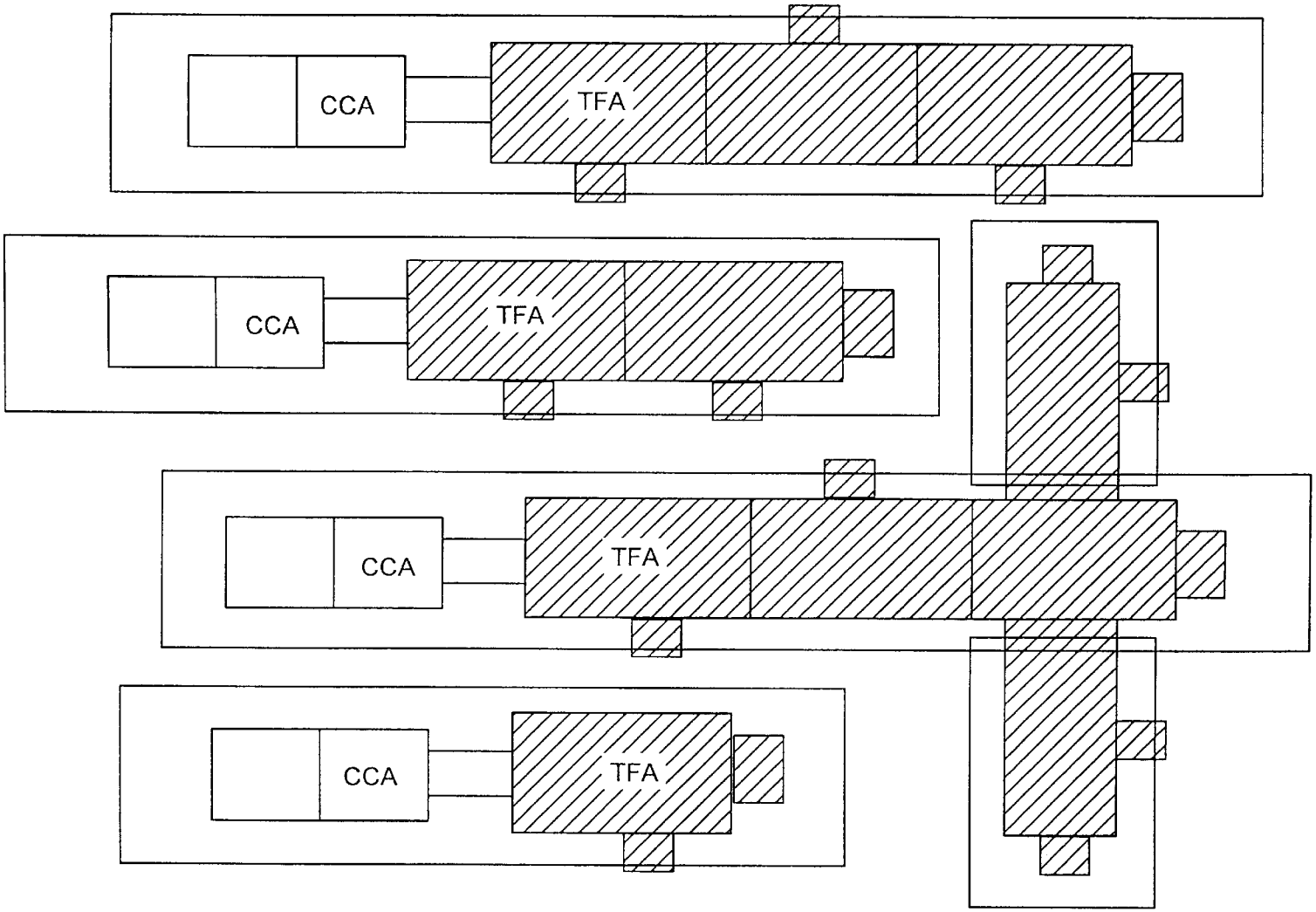
FIG. 8 illustrates the alternative use of the collective protection system in a contaminated area and at the edge of a contaminated area where the system provides an entry/exit to the area.

FIG. 8 illustrates a complex of systems, each provided with its own power and air flow equipment, and providing a CCA and TFA for each system, which is contained within an outer shell independent from each other. Such an arrangement is desirable for certain military applications.

Figure 9:
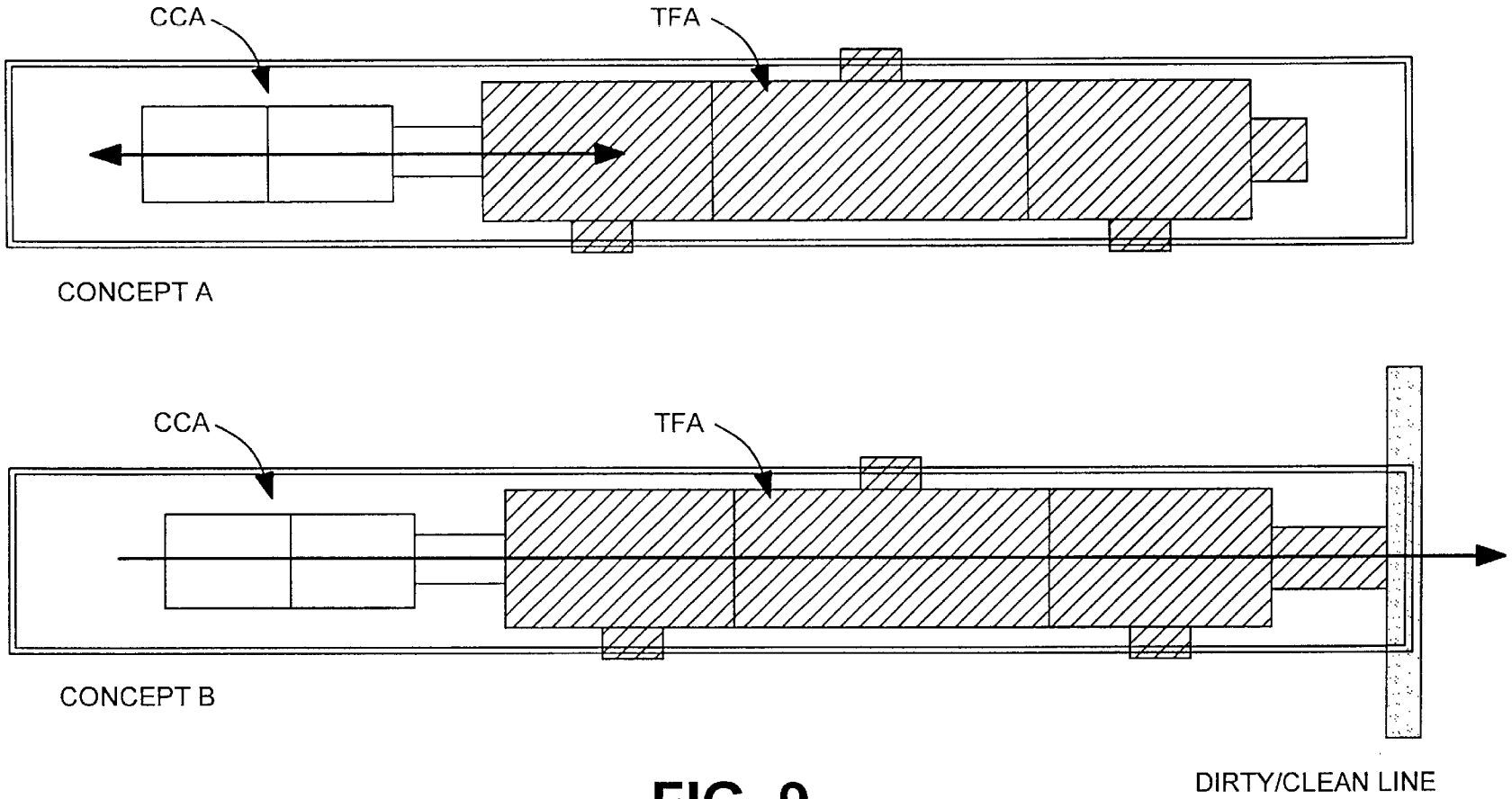

FIG. 9 illustrates two possible environmental locations for systems. The upper view shows a typical setup in a toxic environment, whereas the lower view illustrates a setup at the boundary of a toxic area, where a dirty/clean line has been established and personnel are passed through the system between the contaminated area and the clean or non-contaminated area.

Figure 10:
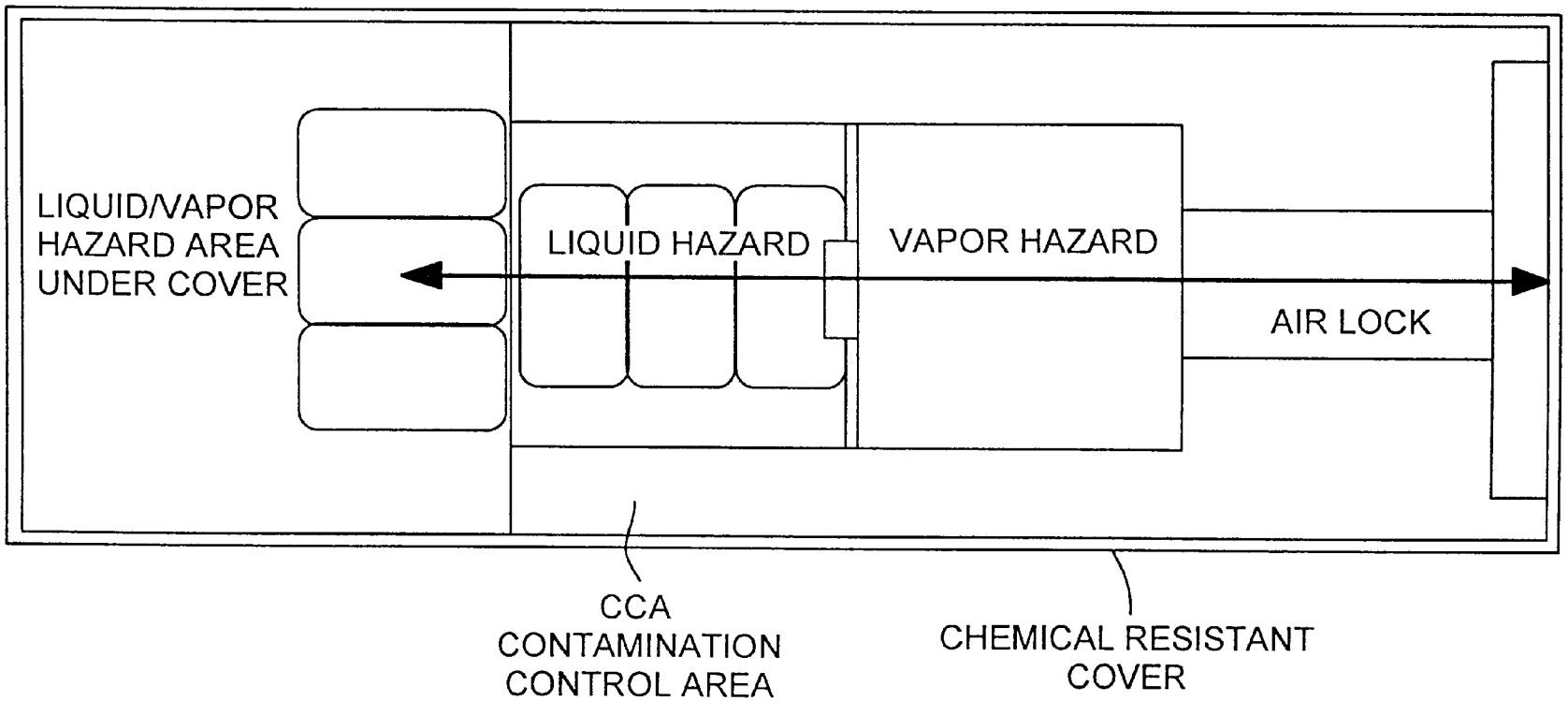
FIG. 10 is a plan view of a contamination control area as part of a collective protection system.

FIG. 10 is a detailed view of the CCA of a system, where a liquid/vapor hazard is provided under the cover of the outer shell, a liquid hazard decontamination area inside the CCA, connected to a vapor hazard decontamination area also within the CCA, but isolated from the liquid hazard area, and connected by an airlock to the TFA.

Figure 11:
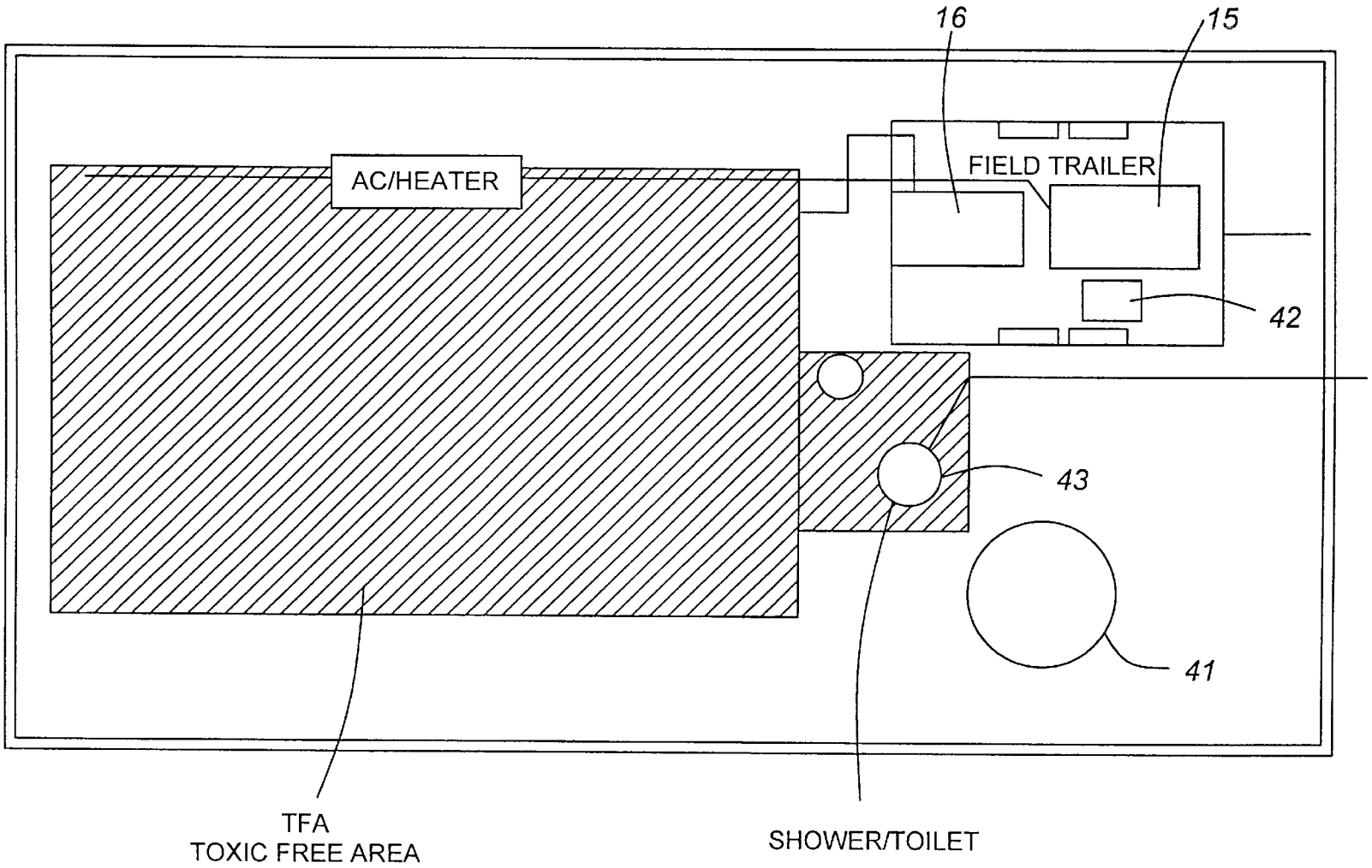
FIG. 11 is a plan view of the toxic free area TFA, with auxiliary equipment attached.

FIG. 11 is a detail of the facilities coupled to the TFA as illustrated in FIG. 7.

Figure 12:
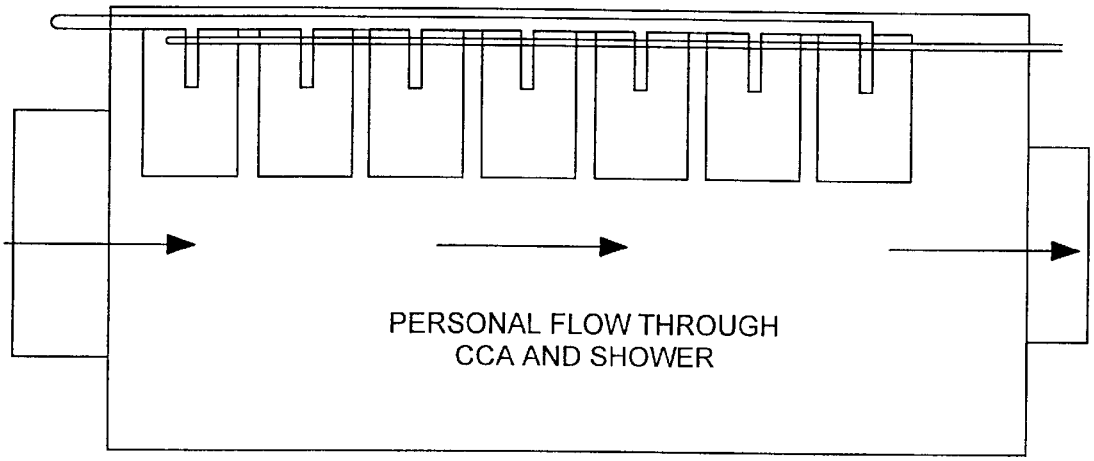
FIG. 12 is a plan and elevation view of a personnel flow-through shower in a collective protection system.
Figure 12:
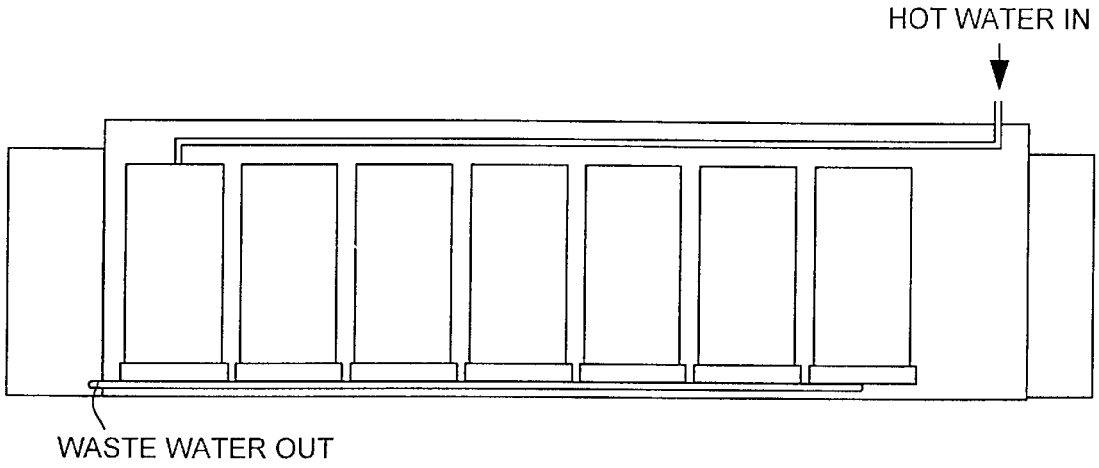

FIG. 12 is a detail of a system in which the CCA consists of a plurality of showers, and personnel flow is left to right and air flow is right to left. Dependent upon the nature of the hazard, such a CCA may be adequate to deal with detoxifying personnel, on their way to the toxic free area (TFA).

Many other configurations of the system are possible, the principle to be observed is that the air flow is counter to the personnel flow and that there be a CCA prior to a TFA for personnel movement. Preferably the inner liner is erected by inflation inside a standard modular tent frame and an outer shell is mounted over the frame. Preferably the system is transportable either on a pallet or a trailer with all electrical and air flow systems included with the system.

I claim:

1. A transportable collective protection system comprising an external standard modular tent frame, an outer shell draped over the frame, said outer shell being formed of woven HDPE, laminated to a barrier film and coated on both sides with LDPE, an inner liner within said frame forming a plurality of sealed enclosures, said inner liner being formed of woven HDPE, laminated to a barrier film, and coated on both sides with LDPE, a power generator, and a source of filtered air under pressure sufficient to inflate the inner sealed enclosures, a first sealed enclosure connected to said source of filtered air under pressure, a second sealed enclosure connected to the first sealed enclosure by a sealed connection, said second sealed enclosure having an entrance distal said first sealed enclosure and being shed to permit casualties to be decontaminated therein, said sealed connection being adapted to permit the passage of personnel into said first sealed enclosure, and to permit air flow from said first to said second sealed enclosure, whereby contaminated personnel may enter said second sealed enclosure, be decontaminated in said second sealed enclosure and enter said first sealed enclosure, while air flows from the first sealed enclosure to the second sealed enclosure and vapor contamination of said first sealed enclosure is prevented by said air flow.

2. A system according to claim 1, wherein said first sealed enclosure is a toxic free area (TFA), and second sealed enclosure is a contamination containment area (CCA).

* * * * *